US006247444B1

(12) United States Patent
Parks

(10) Patent No.: US 6,247,444 B1
(45) Date of Patent: Jun. 19, 2001

(54) ROTARY MOTOR USING PISTONS

(76) Inventor: Adrian Parks, H.C. 71, Box 284, Mountain View, AR (US) 72560

( * ) Notice: Subject to any disclaimer, the term of this patent is extended or adjusted under 35 U.S.C. 154(b) by 0 days.

(21) Appl. No.: 09/595,472

(22) Filed: Jun. 16, 2000

(51) Int. Cl.[7] ..... F02B 53/00
(52) U.S. Cl. ..... 123/245; 418/270; 418/92
(58) Field of Search ..... 123/245, 246, 123/231; 418/92, 270, 35, 37, 38

(56) References Cited

U.S. PATENT DOCUMENTS

| | | | | |
|---|---|---|---|---|
| 1,256,647 | * | 1/1918 | Baudot | 123/245 |
| 1,944,875 | * | 4/1934 | Bullington | 123/245 |
| 2,731,000 | * | 1/1956 | Pelhat | 123/245 |
| 3,646,239 | * | 2/1972 | Cena | 123/245 |
| 3,890,939 | * | 6/1975 | McIntosh | 148/38 |
| 3,893,431 | | 7/1975 | Gregg . | |
| 4,487,176 | | 12/1984 | Kosheleff . | |
| 4,949,688 | * | 8/1990 | Bayless | 123/245 |
| 5,072,705 | | 12/1991 | Overman . | |
| 5,101,782 | | 4/1992 | Yang . | |
| 5,192,201 | * | 3/1993 | Beben | 123/245 |
| 5,357,923 | | 10/1994 | Osterburg et al. . | |
| 5,494,014 | | 2/1996 | Lobb . | |

* cited by examiner

*Primary Examiner*—Thomas Denion
*Assistant Examiner*—Thai-Ba Trieu

(57) ABSTRACT

A rotary motor using pistons for providing a scalable and more efficient, higher speed engine with improved compression. The rotary motor using pistons includes a main housing having and interior, an inlet port in environmental communication with the interior of the housing, an outlet port in environmental communication with the interior of the housing, a spark plug port for receiving a spark plug also in environmental communication with the interior of the housing, a first plate coupled within the housing and rotatable within the interior of the housing, a second plate member coupled within the housing and rotatable within the interior of the housing, a plurality of pistons coupled to an associated one of the first or second plate members, a drive shaft coupled to one of the first or second plate members and extending out of the housing, and an anti-reverse clutch operationally coupled to the drive shaft.

15 Claims, 5 Drawing Sheets

ROTARY MOTOR USING PISTONS

BACKGROUND OF THE INVENTION

1. Field of the Invention

The present invention relates to rotary internal combustion engines and more particularly pertains to a new rotary motor using pistons for providing a scalable and more efficient, higher speed engine with improved compression.

2. Description of the Prior Art

The use of rotary internal combustion engines is known in the prior art. More specifically, rotary internal combustion engines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,072,705; U.S. Pat. No. 5,357,923; U.S. Pat. No. 3,893,431; U.S. Pat. No. 5,101,782; U.S. Pat. No. 4,487,176; and U.S. Pat. No. 5,494,014.

While these devices fulfill their respective, particular objectives and requirements, the aforementioned patents do not disclose a new rotary motor using pistons. The inventive device includes a main housing having and interior, an inlet port in environmental communication with the interior of the housing, an outlet port in environmental communication with the interior of the housing, a spark plug port for receiving a spark plug also in environmental communication with the interior of the housing, a first plate coupled within the housing and rotatable within the interior of the housing, a second plate member coupled within the housing and rotatable within the interior of the housing, a plurality of pistons coupled to an associated one of the first or second plate members, a drive shaft coupled to one of the first or second plate members and extending out of the housing, and an anti-reverse clutch operationally coupled to the drive shaft.

In these respects, the rotary motor using pistons according to the present invention substantially departs from the conventional concepts and designs of the prior art, and in so doing provides an apparatus primarily developed for the purpose of providing a scalable and more efficient, higher speed engine with improved compression.

SUMMARY OF THE INVENTION

In view of the foregoing disadvantages inherent in the known types of rotary internal combustion engines now present in the prior art, the present invention provides a new rotary motor using pistons construction wherein the same can be utilized for providing a scalable and more efficient, higher speed engine with improved compression.

The general purpose of the present invention, which will be described subsequently in greater detail, is to provide a new rotary motor using pistons apparatus and method which has many of the advantages of the rotary internal combustion engines mentioned heretofore and many novel features that result in a new rotary motor using pistons which is not anticipated, rendered obvious, suggested, or even implied by any of the prior art rotary internal combustion engines, either alone or in any combination thereof.

To attain this, the present invention generally comprises a main housing having and interior, an inlet port in environmental communication with the interior of the housing, an outlet port in environmental communication with the interior of the housing, a spark plug port for receiving a spark plug also in environmental communication with the interior of the housing, a first plate coupled within the housing and rotatable within the interior of the housing, a second plate member coupled within the housing and rotatable within the interior of the housing, a plurality of pistons coupled to an associated one of the first or second plate members, a drive shaft coupled to one of the first or second plate members and extending out of the housing, and an anti-reverse clutch operationally coupled to the drive shaft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new rotary motor using pistons apparatus and method which has many of the advantages of the rotary internal combustion engines mentioned heretofore and many novel features that result in a new rotary motor using pistons which is not anticipated, rendered obvious, suggested, or even implied by any of the prior art rotary internal combustion engines, either alone or in any combination thereof.

It is another object of the present invention to provide a new rotary motor using pistons which may be easily and efficiently manufactured and marketed.

It is a further object of the present invention to provide a new rotary motor using pistons which is of a durable and reliable construction.

An even further object of the present invention is to provide a new rotary motor using pistons which is susceptible of a low cost of manufacture with regard to both materials and labor, and which accordingly is then susceptible of low prices of sale to the consuming public, thereby making such rotary motor using pistons economically available to the buying public.

Still yet another object of the present invention is to provide a new rotary motor using pistons which provides in the apparatuses and methods of the prior art some of the advantages thereof, while simultaneously overcoming some of the disadvantages normally associated therewith.

Still another object of the present invention is to provide a new rotary motor using pistons for providing a scalable and more efficient, higher speed engine with improved compression.

Yet another object of the present invention is to provide a new rotary motor using pistons which includes a main housing having and interior, an inlet port in environmental communication with the interior of the housing, an outlet port in environmental communication with the interior of the housing, a spark plug port for receiving a spark plug also in environmental communication with the interior of the housing, a first plate coupled within the housing and rotatable within the interior of the housing, a second plate member coupled within the housing and rotatable within the interior of the housing, a plurality of pistons coupled to an associated one of the first or second plate members, a drive shaft coupled to one of the first or second plate members and extending out of the housing, and an anti-reverse clutch operationally coupled to the drive shaft.

Still yet another object of the present invention is to provide a new rotary motor using pistons that does not require valves.

Even still another object of the present invention is to provide a new rotary motor using pistons that has an improved efficiency over conventional designs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than hose set forth above will become apparent when consideration is given to the following detailed description thereof. Such description makes reference to the annexed drawings wherein.

DESCRIPTION OF THE PREFERRED EMBODIMENT

Figure 1:
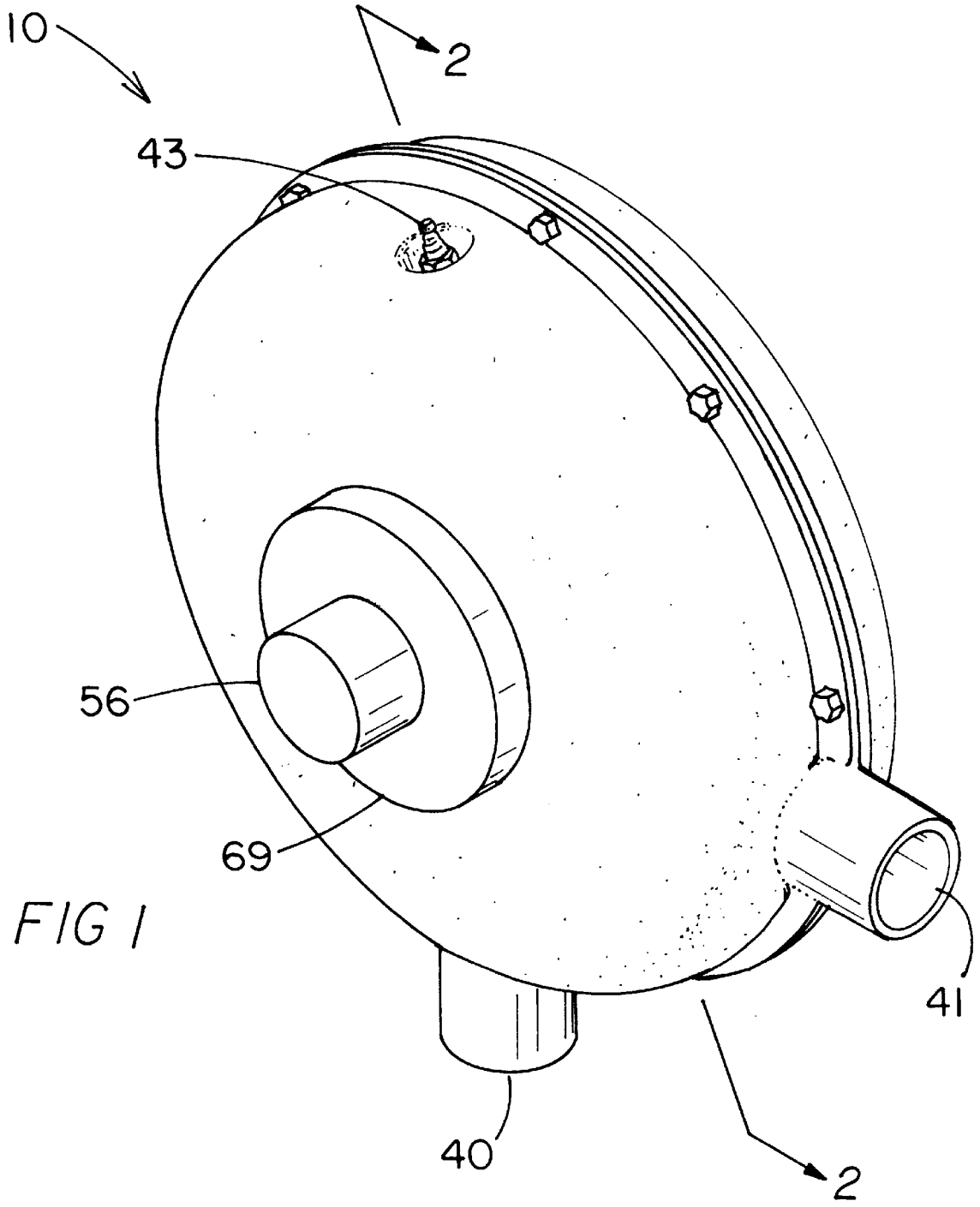
FIG. 1 is a schematic perspective view of a new rotary motor using pistons according to the present invention.
Figure 2:
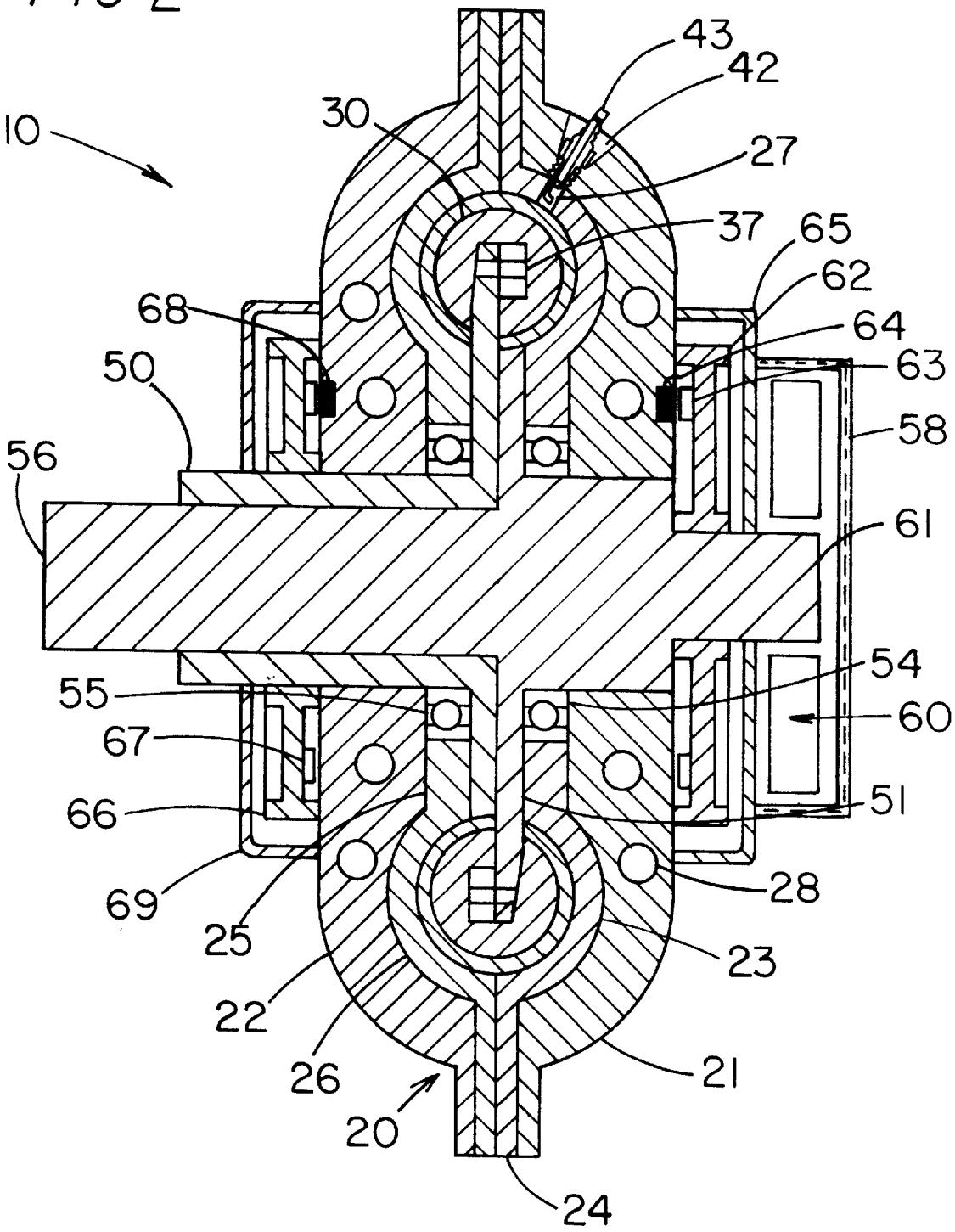
FIG. 2 is a schematic cross-sectional view of the present invention taken along line 2—2 of FIG. 1.
Figure 3:
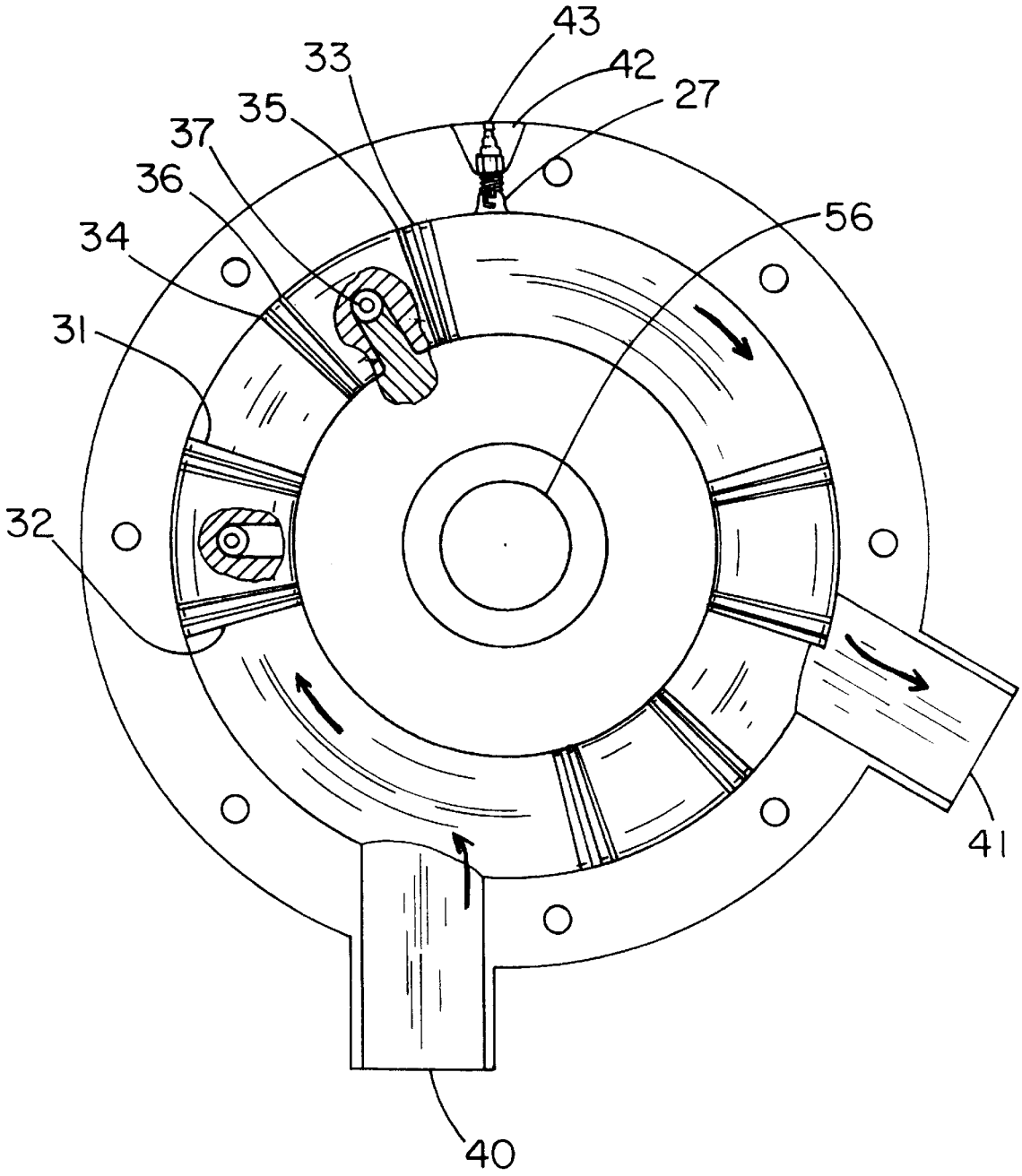
FIG. 3 is a schematic internal view of the present invention during the intake phase.
Figure 4:
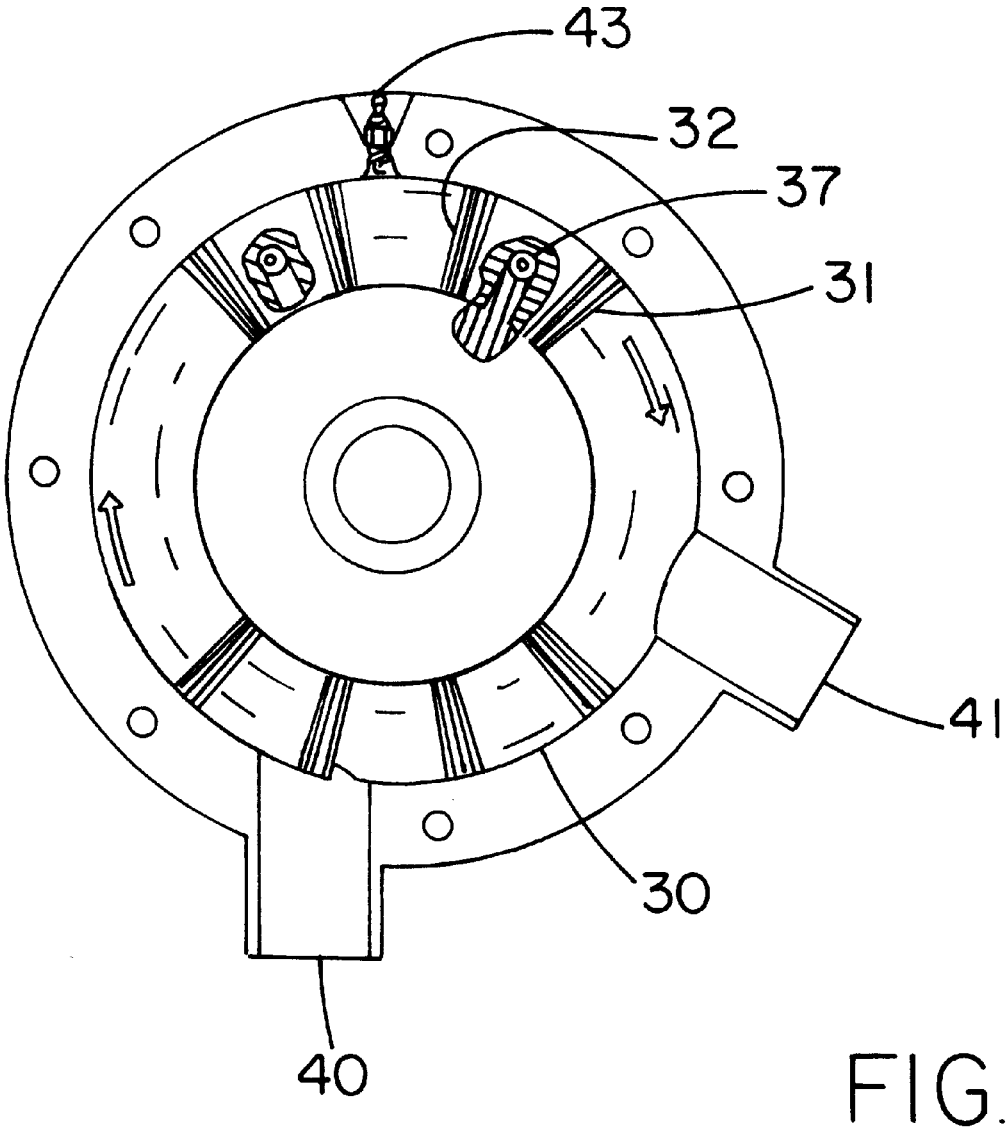
FIG. 4 is a schematic internal view of the present invention at the time of firing.
Figure 5:
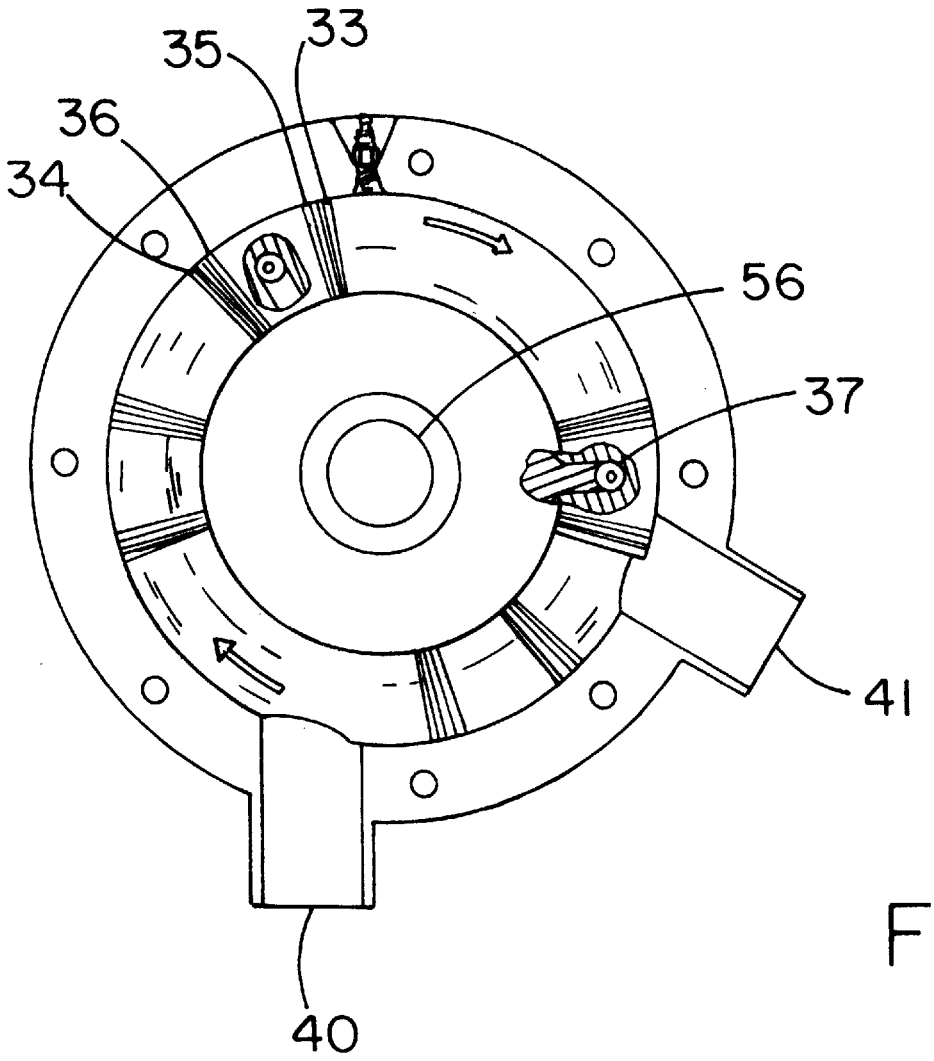
FIG. 5 is a schematic internal view of the present invention during the exhaust phase.

With reference now to the drawings, and in particular to FIGS. 1 through 5 thereof, a new rotary motor using pistons embodying the principles and concepts of the present invention and generally designated by the reference numeral 10 will be described.

As best illustrated in FIGS. 1 through 5, the rotary motor using pistons 10 generally comprises a main housing 20, a plurality of pistons 30, an inlet port 40, and outlet port, 41, a spark plug 43, a plurality of plate members 50–51, a drive shaft 56, and a fly heel assembly 60.

The main housing 20 includes an interior.

The inlet port 40 in environmental communication with the interior of the main housing 20. The interior includes an annular outer portion.

The outlet port 41 in environmental communication with the interior of the main housing 20.

A spark plug port 42 is used for receiving the spark plug 43 such that a firing end of the spark plug 43 is environmental communication with the interior of the main housing 20.

The first plate member 50 is coupled within the main housing 20 such that the first plate 50 is rotatable within the interior of the main housing 20.

The second plate member 51 is coupled within the main housing 20 such that the second plate 51 is rotatable within the interior of the main housing 20.

Each of the pistons 30 is coupled to an associated one of the first 50 and second plates 51 such that the pistons 30 divide the annular outer portion of the interior into a plurality of chambers between adjacently positioned pistons 30.

The inlet port 40 is designed for coupling to a combustible substance source for injecting a combustible substance into each of the chambers when each chamber is positioned adjacent to the inlet port 40.

The spark plug 43 is for igniting the combustible substance in each of the chambers when each of the chambers is positioned adjacent to the spark plug port 42. Thus each adjacently positioned chamber is compressed when the spark plug 43 ignites and an oppositely positioned chamber is expanded when the spark plug 43 ignites. A first one of the adjacently positioned chambers is adjacent to the outlet port 41 when the spark plug 43 fires. Thus combustion residue is expelled from the first one of the adjacently positioned chambers when the first one of the adjacently positioned chambers is compressed. The opposite chamber is positioned adjacent to the inlet port 40. Thus the combustible substance is injected into the opposite chamber when the spark plug 43 ignites. A second one of the adjacent chambers is compressing the combustible substance when the spark plug 43 ignites.

The drive shaft 56 is coupled to one of the first 50 and second plates 51. Thus the drive shaft 56 is turned by rotation of the one of the first 50 and second plates 51. The drive shaft 56 extends out of the main housing 20.

An anti-reverse clutch 58 is operationally coupled to the drive shaft 56 for preventing the drive shaft 56 from rotating in a reverse direction.

A first one of the pistons 30 is coupled to an outer edge of the first plate 50 such that the first piston is positioned in the outer portion of the interior of the main housing 20.

A second one of the pistons 30 is coupled to the outer edge of the first plate 50 opposite the first piston. The second piston is positioned in the outer portion of the interior of the main housing 20.

A third one of the pistons 30 coupled to an outer edge of the second plate 51. The third piston is positioned in the outer portion of the interior of the main housing 20 between the first piston and the second piston thus a first chamber is formed between the first and third pistons and a second chamber is formed between the third and second pistons.

A fourth one of the pistons is coupled to the outer edge of the second plate 51. The fourth piston is positioned in the outer portion of the interior of the main housing 51 between the first and second pistons and opposite the third piston. Thus a third chamber is formed between the first and fourth pistons and a fourth chamber is formed between the fourth and second pistons.

The drive shaft 56 extends from a center of a first face of the first plate 50 and through a center of the second plate 51.

The second plate 51 includes an annular wall extending from the second plate 51 around the drive shaft 56 and out of the main housing 20.

The flywheel assembly 60 comprises a flywheel axle 61 which is integrally coupled to the drive shaft 56, a first plate flywheel 62, a plurality of first plate magnets 63, a first plate coil 64, a first plate flywheel cover 65, a second plate flywheel 66, a plurality of second plate magnets 67, a second plate coil 68, and a second plate flywheel cover 69.

The flywheel axle 61 extends from a center of a second face of the first plate 50 and out of the main housing 20. The first plate flywheel 62 coupled to the flywheel axle 61. Thus the first plate flywheel 62 is rotated by the flywheel axle 61 when the first plate 50 rotates. The plurality of first plate magnets 63 is coupled to the first plate flywheel 63. The first plate flywheel coil 64 is coupled to the main housing 20 such that the plurality of first plate magnets 63 pass over the first plate flywheel coil 64 when the first plate flywheel 62 is rotated. The first flywheel cover member 65 is coupled to the main housing 20 for covering the first plate flywheel 62.

The second plate flywheel 66 is coupled to the annular wall of the second plate 51. Thus the second plate flywheel 66 is rotated by the annular wall of the second plate 51 when the second plate 51 rotates. The plurality of second plate magnets 67 is coupled to the second plate flywheel 66. The second plate flywheel coil 68 is coupled to the main housing 20 such that the plurality of second plate magnets 67 pass over the second plate flywheel coil 68 when the second plate flywheel 66 is rotated. The second flywheel cover member 69 is coupled to the main housing 20 for covering the second plate flywheel 66.

The first plate flywheel 62 includes an annular first plate recessed track facing the main housing 20. The plurality of first plate magnets 63 is positioned in spaced relationship to each other in the first plate recessed track.

The second plate flywheel 66 includes an annular second plate recessed track facing the main housing. The plurality of second plate magnets 67 is positioned in spaced relationship to each other in the second plate recessed track.

The main housing 20 includes a plurality of cooling holes 28 for facilitating cooling of the main housing 20 during use.

The main housing includes a pair of annular cylinder wall members 23. The annular cylinder wall members 23 are positioned in the interior of the main housing 20.

Each of the annular cylinder wall members 23 includes a first planar portion 24 for clamping between a first main housing member 21 and a second main housing member 22. A second planar portion 25 is positioned in a central portion of the interior of the main housing 20. A medial portion 26 extends between the first 24 and second planar portions 25. The medial portion 26 includes an arcuate cross-section along a radial axis of the annular cylinder wall member 23. The medial portion 26 is for positioning in the annular outer portion of the interior of the main housing 20 such that the pistons 30 are positioned between the medial portions 26 of the annular cylinder wall members 23.

One of the annular cylinder wall members 23 includes an aperture 27 which is alignable with the spark plug port 42 for facilitating environmental communication between the spark plug port 42 and the outer annular portion of the interior of the main housing 20.

Each of the pistons 30 includes a first compression ring 33 which is located proximate a leading edge 31 of the piston 30 and a second compression ring 34 which is located proximate a tailing edge 32 of the piston 30.

Each of the pistons 30 is coupled to the associated one of the first 50 and second plates 51 by an associated wrist pin 37 for permitting pivoting of the piston 30 relative to the associated one of the first 50 and second plates 51 for preventing binding at high speeds.

Each of the pistons 30 includes a first oil ring 35 which is located proximate the first compression ring 33 and a second oil ring 36 which is located proximate the second compression ring 34.

A first bearing 54 is positioned between the flywheel axle 61 and an interior end of a first one of the annular cylinder wall members 23.

A second bearing 55 is positioned between the annular wall member of the second plate 51 and an interior end of a second one of the annular cylinder wall members 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotary piston motor comprising:

a main housing having an interior;

an inlet port in environmental communication with said interior of said main housing, said interior having an annular outer portion;

an outlet port in environmental communication with said interior of said main housing;

a spark plug port for receiving a spark plug such that a firing end of said spark plug is environmental communication with said interior of said main housing;

a first plate member coupled within said main housing such that said first plate is rotatable within said interior of said main housing;

a second plate member coupled within said main housing such that said second plate is rotatable within said interior of said main housing;

a plurality of pistons, each of said pistons being coupled to an associated one of said first and second plates such that said pistons divide said annular outer portion of said interior into a plurality of chambers between adjacently positioned pistons;

said inlet port being adapted for coupling to a combustible substance source for injecting a combustible substance into each of said chambers when each chamber is positioned adjacent to said inlet port;

said spark plug being for igniting said combustible substance in each of said chambers when each of said chambers is positioned adjacent to said spark plug port whereby each adjacently positioned chamber is compressed when said spark plug ignites and an oppositely positioned chamber is expanded when said spark plug ignites, a first one of said adjacently positioned chambers being adjacent to said outlet port when said spark plug fires whereby combustion residue is expelled from said first one of said adjacently positioned chambers when said first one of said adjacently positioned chambers is compressed, said opposite chamber being positioned adjacent to said inlet port whereby said combustible substance is injected into said opposite chamber when said spark plug ignites, a second one of said adjacent chambers compressing said combustible substance when said spark plug ignites;

a drive shaft coupled to one of said first and second plates whereby said axle is turned by rotation of said one of said first and second plates, said drive shaft extending out of said main housing; and an anti-reverse clutch operationally coupled to said drive shaft for preventing said drive shaft from rotating in a reverse direction.

2. The rotary piston engine of claim 1, further comprising:

a first one of said pistons being coupled to an outer edge of said first plate such that said first piston is positioned in said outer portion of said interior of said main housing;

a second one of said pistons being coupled to said outer edge of said first plate opposite said first piston, said second piston being positioned in said outer portion of said interior of said main housing;

a third one of said pistons coupled to an outer edge of said second plate, said third piston being positioned in said outer portion of said interior of said main housing between said first piston and said second piston whereby a first chamber is formed between said first and third pistons and a second chamber is formed between said third and second pistons; and a fourth one of said pistons being coupled to said outer edge of said second plate, said fourth piston being positioned in said outer portion of said interior of said main housing between said first and second pistons and opposite said third piston whereby a third chamber is formed between said first and fourth pistons and a fourth chamber is formed between said fourth and second pistons.

3. The rotary piston engine of claim 1, further comprising:

said drive shaft extending from a center of a first face of said first plate and through a center of said second plate;

said second plate having an annular wall extending from said second plate around said drive shaft and out of said main housing.

4. The rotary piston engine of claim 3, further comprising:

a flywheel axle extending from a center of a second face of said first plate and out of said main housing;

a first plate flywheel coupled to said flywheel axle whereby said first plate flywheel is rotated by said flywheel axle when said first plate rotates;

a plurality of first plate magnets coupled to said first plate flywheel; and a first plate flywheel coil coupled to said main housing such that said plurality of first plate magnets pass over said first plate flywheel coil when said first plate flywheel is rotated.

5. The rotary piston engine of claim 4, further comprising:

a first flywheel cover member coupled to said main housing for covering said first plate flywheel.

6. The rotary piston engine of claim 3, further comprising:

a second plate flywheel coupled to said annular wall of said second plate whereby said second plate flywheel is rotated by said annular wall of said second plate when said second plate rotates;

a plurality of second plate magnets coupled to said second plate flywheel; and a second plate flywheel coil coupled to said main housing such that said plurality of second plate magnets pass over said second plate flywheel coil when said second plate flywheel is rotated.

7. The rotary piston engine of claim 6, further comprising:

a second flywheel cover member coupled to said main housing for covering said second plate flywheel.

8. The rotary piston engine of claim 4, further comprising:

said first plate flywheel having an annular first plate recessed track facing said main housing; and said plurality of first plate magnets being positioned in spaced relationship to each other in said first plate recessed track.

9. The rotary piston engine of claim 6, further comprising:

said second plate flywheel having an annular second plate recessed track facing said main housing; and said plurality of second plate magnets being positioned in spaced relationship to each other in said second plate recessed track.

10. The rotary piston engine of claim 1, further comprising:

said main housing having a plurality of cooling holes for facilitating cooling of said main housing during use.

11. The rotary piston engine of claim 1, further comprising:

a pair of annular cylinder wall members, said annular cylinder wall members being positioned in said interior of said main housing;

each of said annular cylinder wall members including a first planar portion for clamping between said a first main housing member and a second main housing member, a second planar portion for positioning in a central portion of said interior of said main housing, and a medial portion extending between said first and second planar portions, said medial portion having an arcuate cross-section along a radial axis of said annular cylinder wall member, said medial portion being for positioning in said annular outer portion of said interior of said main housing such that said pistons are positioned between said medial portions of said annular cylinder wall members; and one of said annular cylinder wall members having an aperture alignable with said spark plug port for facilitating environmental communication between said spark plug port and said outer annular portion of said interior of said main housing.

12. The rotary piston engine of claim 1, further comprising:

each of said pistons including a first compression ring proximate a leading edge of said piston and a second compression ring proximate a tailing edge of said piston.

13. The rotary piston engine of claim 1, further comprising:

each of said pistons being coupled to said associated one of said first and second plates by an associated wrist pin for permitting pivoting of said piston relative to said associated one of said first and second plates for preventing binding at high speeds.

14. The rotary piston engine of claim 1, further comprising:

each of said pistons including a first oil ring proximate a leading edge of said piston and a second oil ring proximate a tailing edge of said piston.

15. A rotary piston motor comprising:

a main housing having an interior;

an inlet port in environmental communication with said interior of said main housing, said interior having an annular outer portion;

an outlet port in environmental communication with said interior of said main housing;

a spark plug port for receiving a spark plug such that a firing end of said spark plug is environmental communication with said interior of said main housing;

a first plate member coupled within said main housing such that said first plate is rotatable within said interior of said main housing;

a second plate member coupled within said main housing such that said second plate is rotatable within said interior of said main housing;

a plurality of pistons, each of said pistons being coupled to an associated one of said first and second plates such that said pistons divide said annular outer portion of said interior into a plurality of chambers between adjacently positioned pistons;

said inlet port being adapted for coupling to a combustible substance source for injecting a combustible substance into each of said chambers when each chamber is positioned adjacent to said inlet port;

said spark plug being for igniting said combustible substance in each of said chambers when each of said chambers is positioned adjacent to said spark plug port whereby each adjacently positioned chamber is compressed when said spark plug ignites and an oppositely positioned chamber is expanded when said spark plug ignites, a first one of said adjacently positioned chambers being adjacent to said outlet port when said spark plug fires whereby combustion residue is expelled from said first one of said adjacently positioned chambers when said first one of said adjacently positioned chambers is compressed, said opposite chamber being positioned adjacent to said inlet port whereby said combustible substance is injected into said opposite chamber when said spark plug ignites, a second one of said adjacent chambers compressing said combustible substance when said spark plug ignites;

a drive shaft coupled to one of said first and second plates whereby said axle is turned by rotation of said one of said first and second plates, said drive shaft extending out of said main housing;

an anti-reverse clutch operationally coupled to said drive shaft for preventing said drive shaft from rotating in a reverse direction;

a first one of said pistons being coupled to an outer edge of said first plate such that said first piston is positioned in said outer portion of said interior of said main housing;

a second one of said pistons being coupled to said outer edge of said first plate opposite said first piston, said second piston being positioned in said outer portion of said interior of said main housing;

a third one of said pistons coupled to an outer edge of said second plate, said third piston being positioned in said outer portion of said interior of said main housing between said first piston and said second piston whereby a first chamber is formed between said first and third pistons and a second chamber is formed between said third and second pistons;

a fourth one of said pistons being coupled to said outer edge of said second plate, said fourth piston being positioned in said outer portion of said interior of said main housing between said first and second pistons and opposite said third piston whereby a third chamber is formed between said first and fourth pistons and a fourth chamber is formed between said fourth and second pistons;

said drive shaft extending from a center of a first face of said first plate and through a center of said second plate;

said second plate having an annular wall extending from said second plate around said drive shaft and out of said main housing;

a flywheel axle extending from a center of a second face of said first plate and out of said main housing;

a first plate flywheel coupled to said flywheel axle whereby said first plate flywheel is rotated by said flywheel axle when said first plate rotates;

a plurality of first plate magnets coupled to said first plate flywheel;

a first plate flywheel coil coupled to said main housing such that said plurality of first plate magnets pass over said first plate flywheel coil when said first plate flywheel is rotated;

a first flywheel cover member coupled to said main housing for covering said first plate flywheel;

a second plate flywheel coupled to said annular wall of said second plate whereby said second plate flywheel is rotated by said annular wall of said second plate when said second plate rotates;

a plurality of second plate magnets coupled to said second plate flywheel;

a second plate flywheel coil coupled to said main housing such that said plurality of second plate magnets pass over said second plate flywheel coil when said second plate flywheel is rotated;

a second flywheel cover member coupled to said main housing for covering said second plate flywheel;

said first plate flywheel having an annular first plate recessed track facing said main housing;

said plurality of first plate magnets being positioned in spaced relationship to each other in said first plate recessed track;

said second plate flywheel having an annular second plate recessed track facing said main housing;

said plurality of second plate magnets being positioned in spaced relationship to each other in said second plate recessed track;

said main housing having a plurality of cooling holes for facilitating cooling of said main housing during use;

a pair of annular cylinder wall members, said annular cylinder wall members being positioned in said interior of said main housing;

each of said annular cylinder wall members including a first planar portion for clamping between said a first main housing member and a second main housing member, a second planar portion for positioning in a central portion of said interior of said main housing, and a medial portion extending between said first and second planar portions, said medial portion having an arcuate cross-section along a radial axis of said annular cylinder wall member, said medial portion being for positioning in said annular outer portion of said interior of said main housing such that said pistons are positioned between said medial portions of said annular cylinder wall members;

one of said annular cylinder wall members having an aperture alignable with said spark plug port for facilitating environmental communication between said spark plug port and said outer annular portion of said interior of said main housing;

each of said pistons including a first compression ring proximate a leading edge of said piston and a second compression ring proximate a tailing edge of said piston;

each of said pistons being coupled to said associated one of said first and second plates by an associated wrist pin for permitting pivoting of said piston relative to said associated one of said first and second plates for preventing binding at high speeds;

each of said pistons including a first oil ring proximate said first compression ring and a second oil ring proximate said second compression ring;

a first bearing positioned between said flywheel axle and an interior end of a first one of said annular cylinder wall members; and a second bearing positioned between said annular wall member of said second plate and an interior end of a second one of said annular cylinder wall members.

* * * * *